US008534462B1

(12) United States Patent
Tan

(10) Patent No.: US 8,534,462 B1
(45) Date of Patent: Sep. 17, 2013

(54) FILM BAGS IN A DISPENSING CONTAINER

(76) Inventor: Daniel Brian Tan, Harahan, CA (US)

( * ) Notice: Subject to any disclaimer, the term of this patent is extended or adjusted under 35 U.S.C. 154(b) by 0 days.

(21) Appl. No.: 13/454,406

(22) Filed: Apr. 24, 2012

(51) Int. Cl.
*B65D 33/14* (2006.01)

(52) U.S. Cl.
USPC ..... 206/554; 206/494; 383/37; 383/9

(58) Field of Classification Search
USPC ..... 206/554, 459.5, 449, 494; 383/8, 383/9, 13, 26, 37
See application file for complete search history.

(56) References Cited

U.S. PATENT DOCUMENTS

| | | | | |
|---|---|---|---|---|
| 2,696,325 | A * | 12/1954 | Beier | 206/554 |
| 3,319,867 | A | 5/1967 | Vrana | |
| 3,738,482 | A | 6/1973 | Cwikla | |
| 4,527,693 | A * | 7/1985 | Membrino | 206/554 |
| 5,678,728 | A | 10/1997 | Leto | |
| 5,865,313 | A * | 2/1999 | Huang et al. | 206/554 |
| 6,098,806 | A * | 8/2000 | Mills | 206/554 |
| 6,179,126 | B1 * | 1/2001 | Smithson et al. | 206/554 |
| 6,354,462 | B1 | 3/2002 | Conran et al. | |
| 6,401,971 | B1 | 6/2002 | Edwards et al. | |
| 6,585,197 | B1 * | 7/2003 | Daniels | 206/554 |
| 6,655,546 | B1 * | 12/2003 | Bolton et al. | 206/554 |
| 6,772,909 | B2 | 8/2004 | Bateman | |
| 7,275,657 | B2 | 10/2007 | Geyer | |
| 7,360,667 | B2 | 4/2008 | Stravitz | |
| 7,380,667 | B2 | 6/2008 | Divine | |
| 2003/0224962 | A1 | 12/2003 | Fryc | |
| 2004/0040974 | A1 | 3/2004 | Chen | |
| 2005/0047685 | A1 * | 3/2005 | Tsutsumi | 206/554 |
| 2005/0252819 | A1 | 11/2005 | Chum | |
| 2006/0283765 | A1 | 12/2006 | Smithson et al. | |
| 2008/0257778 | A1 * | 10/2008 | Dickinson | 206/554 |

FOREIGN PATENT DOCUMENTS

| | | | |
|---|---|---|---|
| JP | 51-104836 | U | 8/1976 |
| KR | 20-2000-0010456 | U | 6/2000 |

* cited by examiner

*Primary Examiner* — Mickey Yu
*Assistant Examiner* — Chun Cheung
(74) *Attorney, Agent, or Firm* — David A. Belasco; Belasco Jacobs & Townsley, LLP

(57) ABSTRACT

Film bags are dispensed from a container having an opening. Each of the film bags has a dispensed portion and a remaining portion and includes front and rear walls joined at their first and second side edges. The walls are sealed at the bottom edges and have a top edge. An upper portion of the bags is penetrated by two openings. The openings surround a center portion that extends upwardly toward to join the remaining portion formed by the openings and the top edges. The remaining portion has at least one frangible attachment to the dispensed portion. An optional bag stack insert has a notch at a first end that aligns with the opening. Each bag stack is secured to an insert with a lower end of the stack folded under the first end and the stack inserted into the container with the folded stack portion located adjacent the opening.

23 Claims, 11 Drawing Sheets

FILM BAGS IN A DISPENSING CONTAINER

RELATED APPLICATION

The instant application is a continuation of PCT Application Ser. No. PCT/US11/42848 filed on Jul. 1, 2011 and claims priority to the filing date thereof.

FIELD OF INVENTION

This invention relates to the field of plastic and other film bags and dispensing systems and more specifically to bags designed specifically for use with disposable dispensing containers.

BACKGROUND OF THE INVENTION

As counter space is usually at a premium in supermarkets and grocery stores, it is desirable to have bag dispensing systems that use a minimum of such space, are adaptable to a variety of dispenser mounting systems and provide means for keeping bags neat and orderly in the store. For most bag dispensing systems, other than roll mounted bag systems, the bags are acquired in bag packs in which a quantity of bags are adhered together for later dispensing. Typically these bag packs are packed in boxes for shipping and the bag packs must be removed from the boxes and then mounted on dispensing racks. The racks are typically installed in fixed locations. After the dispensers are loaded, the shipping boxes must then be removed from the workplace. One of the advantages of rack-type dispensing systems is that, through a variety of technologies, the bags can be made to self open when withdrawn from the dispensing rack. This makes loading the bags easier for the user. A variety of systems have been developed to provide bags and self opening bags for supermarket or grocery use. Some dispensing systems have been developed that use the container in which the bags are provided as a dispenser. The present invention combines the use of the container with the provision of self opening features for some embodiments. Some examples of the prior art include the following.

U.S. Pat. No. 6,655,546, issued to Bolton et al., discloses a pre-formed bag dispenser and bags therefore. The dispenser has a container in the form of a rectangular box-like cover having an open end into which a support slides. The support is in the form of an oblong flat plate having a rectangular opening and a locating block fixed on its surface. Catches are provided in the sides of the container which snap into engagement with notches in the support so as to retain the support positively in the container when the support is inserted fully into the container. Both the container and the support may be made of cardboard. A stack of bags is loaded on the support and the bags have parallel handles at the mouth end. A bar block formed with the stack spans and extends across the outer ends of the handles to which it is separately joined by lines of weakening. A rectangular slot is formed through the stack which defines mouth and handles. The slot is of complimentary size and shape to the locating block on the support. After the support is loaded with the bags, the support is inserted into the open end of the container so that the bags may be dispensed individually through the access aperture in the container.

U.S. Pat. No. 4,527,693, issued to Membrino is directed a box dispenser for a pad of plastic bags. The plastic bag storage and dispensing unit comprises a box made of paper or cardboard and a pad of plastic bags positioned within the box. The pad of bags is made up of a stack of bag pockets each with an open mouth and a free edge forming the upper edge of the front wall of the pocket. A pad is placed against the inside surface of the front wall of the box blank and the base portion of the pad is connected to the wall by means of staples. The box is then formed around the pad by folding on fold lines to form the upper and lower walls of the box. In order to gain access to the plastic bags, a tear is made along a scored pattern so that a bottom hinge flap remains which can be removed. The top most bag then appears in the opening and can be removed by simply grasping the lip formed by its edge and pulling forward individually as required. The rear wall of the box to which the pad is stapled acts as a stabilizer means to prevent collapse of the pad within the box. The entire unit comprises a box blank and a pad of plastic bags and is assembled such that the backer conforms to the inner surfaces of the box to hold the pad securely therein.

U.S. Pat. No. 7,275,657, issued to Geyer illustrates a bag dispenser that is formed from a blank that is cut and formed with appropriate fold lines and assembled to contain and dispense individual plastic bags provided in a stack. The carton is formed from a single sheet or blank of material such as corrugated cardboard which has been cut and folded to create the dispenser. The bottom wall along with back walls and first and second sidewalls define a receptacle for receiving a stack of plastic bags therein. The carton has an opening which provides access to the receptacle wherein the plastic bags are stored and may be individually removed.

U.S. Pat. No. 6,354,462, issued to Conran et al. discloses a paper dispenser containing a removable case. The dispenser comprises a housing which is configured to receive a cartridge mounted on the inside of the housing and particularly matching the paper sheets to be dispensed. The cartridge is received in the lower portion of the housing to rest against the lower end wall. The vertical sidewalls of the cartridge include a flaring upper portion forming a hopper to facilitate reloading the cartridge with a new stack of paper sheets. The cartridge is inserted and kept in place inside the housing by an elastic nesting means.

U.S. Pat. No. 6,772,909, issued to Bateman is directed to a bag dispenser which is formed from a planar sheet of material wherein a portion of the sheet is cut to form a bendable flap that assists in supporting the flexible bags held within.

U.S. Pat. No. 3,738,482, issued to Cwikia discloses a flexible bag package article wherein a plurality of flattened stacked flexible bags are placed on a wicket and attached to an inner carton element followed by placing the stacked bags in an inner carton element into an outer carton element. A flattened stacked package of bags is formed with wicket holes and are joined together to form a stack utilizing a wicket fabricated of a metal rod or wire. The stack of bags is arranged on a bottom panel at a tray folder element which is precut and formed to provide an additional bottom panel. The tray folder element may then be formed to include a hole to facilitate the pulling and removing of a packaged article from the bulk package. To provide additional protection, a liner may be placed between the assembled stack of bags and the carton elements. The liner may be an open ended bag of plastic or the like of sufficient size to accommodate the bag. A plurality of the packaged articles may then be assembled in a bulk carton and the individual bags may be dispensed or removed individually.

It is an objective of the present invention to provide a bag dispensing system that uses the cartons or boxes in which the bags are provided as a dispenser. It is a further objective to provide a system that offers self opening bags. It is a still further objective of the invention to provide a dispensing system adaptable to a variety of different mountings. It is yet a further objective to provide such a system that can be used without a mounting device. Finally, it is an objective of the present invention to provide a bag dispensing system that is durable, inexpensive and simple to use.

While some of the objectives of the present invention are disclosed in the prior art, none of the inventions found include all of the requirements identified.

SUMMARY OF THE INVENTION

The present invention addresses all of the deficiencies of prior art dispensers for film bags in dispensing containers and satisfies all of the objectives described above.

(1) Film bags in a dispensing container providing the desired features may be constructed from the following components. A dispensing container is provided. The dispensing container is formed of resilient material and has an opening. At least one stack of film bags is provided. Each of the bags includes front and rear film walls. Each of the front and rear walls have first and second side edges, a top edge and a bottom edge. The front and rear walls are integrally joined at the first and second side edges and are secured together at the bottom edges.

Each of the bags includes a dispensed portion and a remaining portion. The dispensed portion is removable from the dispensing container through the opening and the remaining portion is retained within the container. The dispensed portion is removably attached to the remaining portion with at least one frangible attachment. The at least one bag stack is sized and shaped to fit within the dispensing container. The bag stack is located within the dispensing container.

(2) In a variant of the invention, each of the bags in the bag stack is adhered to an adjacent bag in the bag stack.

(3) In another variant, the remaining portion is retained within the container by attaching the remaining portion of the bags in the bag stack to the container with a fastener selected from the group that includes staples, wires, tape, ties, glue and cord.

(4) In a further variant, the remaining portion is retained within the container by attaching the remaining portion of the bags in the bag stack to at least one bag stack holder insert. The insert is formed of a resilient material. The insert has a first end, a second end, a first predetermined length and has a notch at the first end. The notch is sized and shaped to at least partially align with the opening in the dispensing container and to permit access to the bags in the at least one bag stack. Each of the bag stacks is secured at the remaining portion to one of the inserts with the top edge located adjacent a first line spaced from the first end. The at least one bag stack holder insert is located within the dispensing container.

(5) In still another variant, the remaining portion of the bags in the bag stack are attached to the at least one bag stack holder insert with a fastener selected from the group that includes staples, wires, tape, ties cord, glue and folded resilient material.

(6) In yet another variant, an upper portion of the front and rear walls are penetrated by first and second openings. The first opening commencing at a first point spaced downwardly from the top edge and inwardly from the first side edge, extending downwardly for a first predetermined distance, inwardly to a first side of a base of a center portion, upwardly along a first side of the center portion and outwardly to the first point. The second opening commencing at a second point spaced downwardly from the top edge and inwardly from the second side edge, extending downwardly for the first predetermined distance, inwardly to a second side of the base of the center portion, upwardly along a second side of the center portion and outwardly to the second point. The first and second openings leave the center portion and extend upwardly toward the top edge and join the remaining portion. The remaining portion has a frangible attachment to at least the center portion.

(7) In a further variant, the bags further include an upper seam. The upper seam seals the front wall to the rear wall adjacent the top edges. The remaining portion extends between first and second bag handles formed by the openings and the upper seam. The remaining portion has an additional frangible attachment to at least one of the first and second bag handles. The upper seam is penetrated by a cut-out. The cut-out commences at a third point along the upper seam spaced inwardly from the first side edge and extends to a fourth point along the upper seam spaced inwardly from the second side edge. The cut-out extends downwardly toward the dispensed portion, thereby defining a width for the first and second bag handles.

(8) In still a further variant, a lower end of the bag stack is folded under the first end of the insert and the bag stack is placed in the dispensing container with a folded portion of the bag stack located adjacent the opening.

(9) In yet a further variant, the opening in the dispensing container further includes surrounding perforations to assist in forming the opening in the container.

(10) In another variant of the invention, each of the bags further includes longitudinally oriented side gussets, the side gussets forming multi-layered handles in the bags.

(11) In still another variant, each of the bags further includes a bottom gusset.

(12) In yet another variant, the frangible attachment is selected form the group includes U-shaped knife cuts, wave-shaped knife cuts, straight knife cuts, shredding and perforations.

(13) In a further variant, each of the bags in the bag stack is adhered to an adjacent bag in the bag stack using a method selected from the group includes cold staking, hot pinning, multiple corona treatment, knife cutting, special resin formulations, and glue spotting.

(14) In still a further variant, at least an upper portion of an outer surface of either of the front and rear walls of each of the bags has been corona treated.

(15) In yet a further variant, lower ends of the first and second openings further include stress relieving features. The stress relieving features includes outward and downward curving edges. The edges then extend upwardly to join the first and second side edges of the center portion.

(16) In another variant of the invention, each of the bag stacks is secured with any of staples, wires, tape, ties, glue and cord at the remaining portion to one of the inserts with the top edge located adjacent the first line spaced from the first end. The insert so secured to the bag stack has a second predetermined length.

(17) In still another variant, a central portion of the insert includes at least one slit and the second end of the insert includes at least one mating tab. The tab secures the second end of the insert over the top edges and the remaining portion.

(18) In yet another variant, the insert further includes a second line spaced toward the second end from the first line. The second line is spaced by approximately a thickness of the at least one bag stack.

(19) In a further variant, the first and second lines are creases in the insert, the creases serving to ease folding of the insert over the bag stack.

(20) In still a further variant, graphic images are located upon at least one outer surface of the dispensing container.

(21) In yet a further variant, the dispensing container has a top, a bottom, a first side, a second side a front and a back and the opening penetrates at least part of any of the top, the bottom, the first side, the second side, the front and the back.

(22) In another variant of the invention, at least one inner surface of the first and second sides of the dispensing container is located slidably adjacent at least one of the first and second side edges of the front and rear walls of the film bags, thereby providing friction as the bags are withdrawn from the dispensing container.

(23) In still another variant, the folded portion of the bag stack includes the center portion of the bags, thereby providing a grasping point for withdrawal of the bags from the dispensing container.

(24) In yet another variant, the bags are packaged into bag packs. The bag packs are inserted into the dispensing container. The bag packs include at least one stack of bags. The at least one stack of bags is located within an outer wrapper. The outer wrapper is formed of flexible material, surrounds the at least one bag stack and has an aperture. The aperture provides access to at least one of upper and lower surfaces of bags of the at least one bag stack for removal of the bags through the opening in the dispensing container.

(25) In a further variant, the bags further include handle openings. The handle openings penetrate the front and rear film walls.

(26) In a final variant of the invention, the handle openings have a shape selected from the group that includes round, oval, rectangular, triangular, hexagonal, octagonal, trapezoidal and finger gripped.

An appreciation of the other aims and objectives of the present invention and an understanding of it may be achieved by referring to the accompanying drawings and the detailed description of a preferred embodiment.

DESCRIPTION OF THE DRAWINGS

DETAILED DESCRIPTION OF THE PREFERRED EMBODIMENT (1) FIGS. 1-19 illustrate film bags in a dispensing container 10 providing the desired features that may be constructed from the following components. As illustrated in FIGS. 1, 7, 13 and 16, a dispensing container 14 is provided. The dispensing container 14 is formed of resilient material 166 and has an opening 42. As illustrated in FIGS. 4, 5, 14, 15, 18 and 19, at least one stack 46 of film bags 50 is provided. Each of the bags 50 includes front 54 and rear 58 film walls. Each of the front 54 and rear 58 walls have first 62 and second 66 side edges, a top edge 70 and a bottom edge 74. The front 54 and rear 58 walls are integrally joined at the first 62 and second 66 side edges and are secured together at the bottom edges 74.

Figure 1:
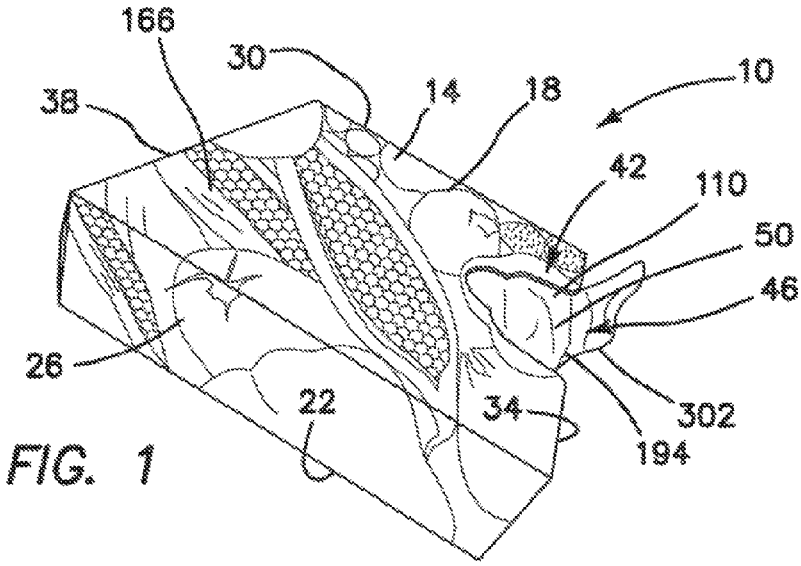
FIG. 1 is a perspective view of the preferred embodiment of the invention illustrating a tear-out opening and a bag partially withdrawn from a dispensing container.
Figure 2:
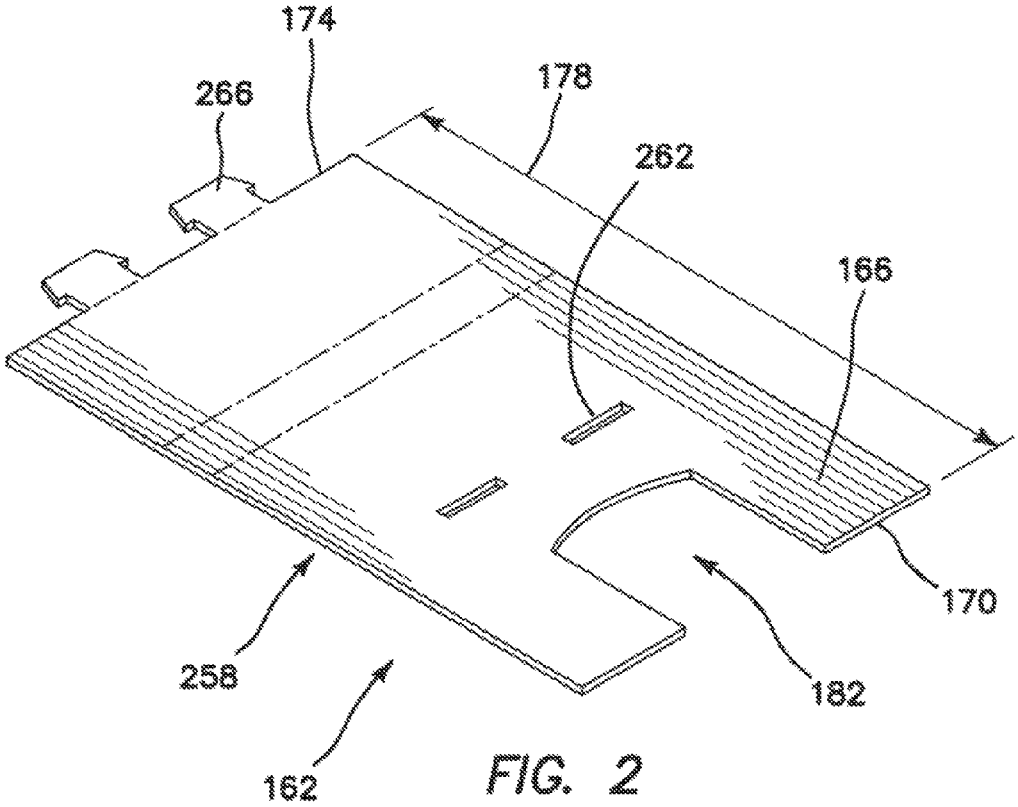
FIG. 2 is a perspective view of a bag stack holder insert of the FIG. 1 embodiment.
Figure 3:
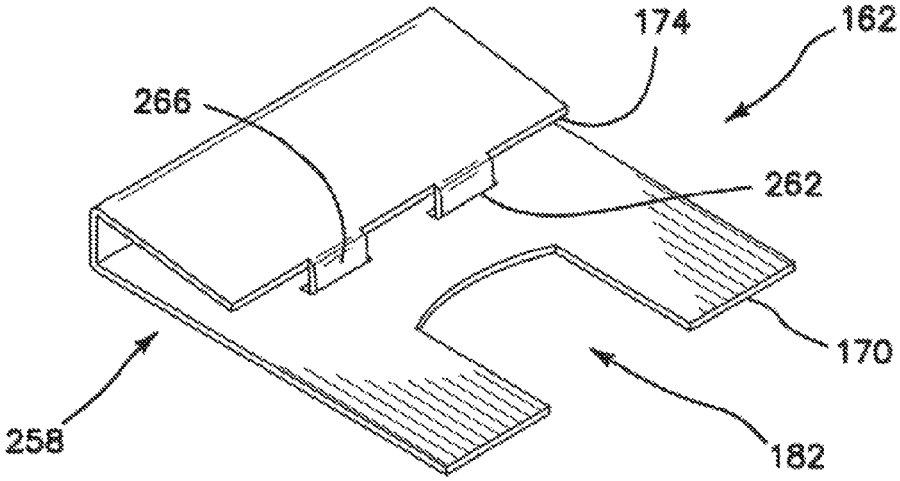
FIG. 3 is a perspective view of the bag stack holder insert of the FIG. 2 embodiment folded to illustrate insertion of the tabs into the slots.

Each of the bags 50 includes a dispensed portion 52 and a remaining portion 56. The dispensed portion 52 is removable from the dispensing container 14 through the opening 42 and the remaining portion 56 is retained within the container 14. The dispensed portion 52 is removably attached to the remaining portion 56 with at least one frangible attachment 158. The at least one bag stack 46 is sized and shaped to fit within the dispensing container 14. The bag stack 46 is located within the dispensing container 14.

(2) In a variant of the invention, each of the bags 50 in the bag stack 46 is adhered to an adjacent bag 50 in the bag stack 46.

Figure 9:
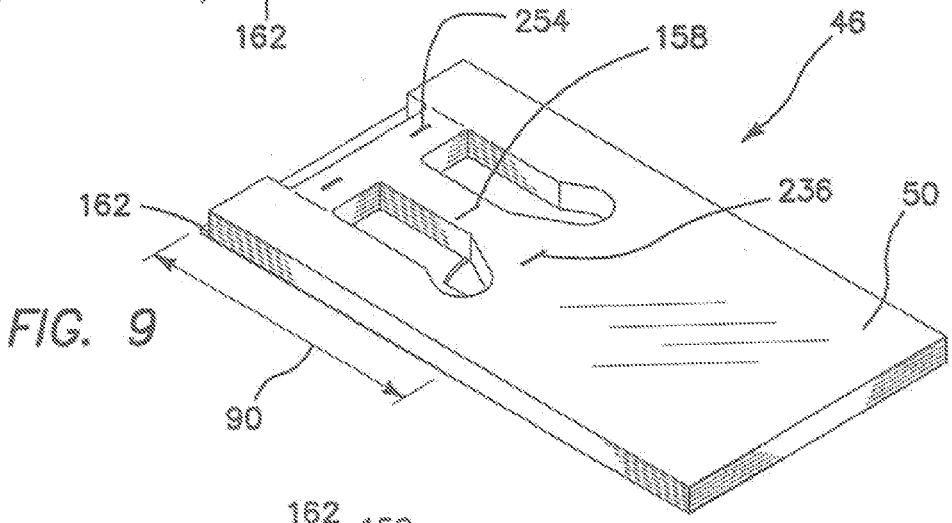
FIG. 9 is a perspective view of a bag stack attached to the FIG. 8 insert with staples.

(3) In another variant, as illustrated in FIG. 9, the remaining portion 56 is retained within the container 14 by attaching the remaining portion 56 of the bags 50 in the bag stack 46 to the container 14 with a fastener 60 selected from the group that includes staples 64, wires (not shown), tape (not shown), ties (not shown), glue (not shown) and cord (not shown).

(4) In a further variant, the remaining portion 56 is retained within the container 14 by attaching the remaining portion 56 of the bags 50 in the bag stack 46 to at least one bag stack holder insert 162. The insert 162 is formed of a resilient material 166. The insert 162 has a first end 170, a second end 174, a first predetermined length 178 and has a notch 182 at the first end 170. The notch 182 is sized and shaped to at least partially align with the opening 42 in the dispensing container 14 and to permit access to the bags 50 in the at least one bag stack 46. Each of the bag stacks 46 is secured at the remaining portion 56 to one of the inserts 162 with the top edge 70 located adjacent a first line 186 spaced from the first end 170. The at least one bag stack holder insert 162 is located within the dispensing container 14.

(5) In still another variant, the remaining portion 56 of the bags 50 in the bag stack 46 are attached to the at least one bag stack holder insert 162 with a fastener 60 selected from the group that includes staples 64, wires (not shown), tape (not shown), ties (not shown), glue (not shown) and cord (not shown) and folded resilient material 166, as illustrated in FIGS. 2, 5, 6, 7, 10, 16 and 17.

Figure 4:
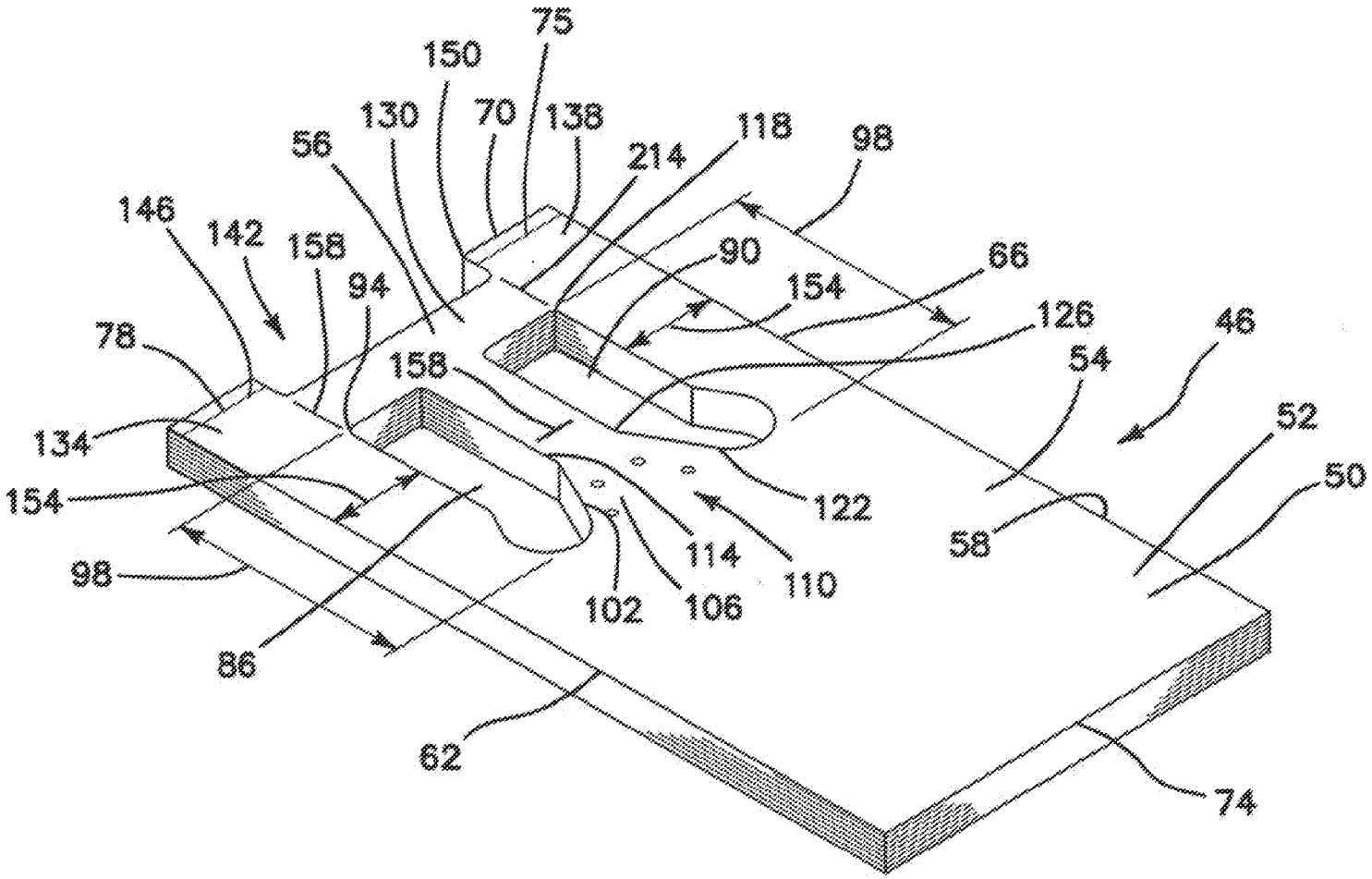
FIG. 4 is a perspective view a bag stack for use with the FIG. 1 embodiment.

(6) In yet another variant, as illustrated in FIG. 4, an upper portion 82 of the front 54 and rear 58 walls are penetrated by first 86 and second 90 openings. The first opening 86 begins at a first point 94 spaced downwardly from the top edge 70 and inwardly from the first side edge 62, extends downwardly for a first predetermined distance 98, inwardly to a first side 102 of a base 106 of a center portion 110, upwardly along a first side 114 of the center portion 110 and outwardly to the first point 94. The second opening 90 begins at a second point 118 spaced downwardly from the top edge 70 and inwardly from the second side edge 66, extends downwardly for the first predetermined distance 98, inwardly to a second side 122 of the base 106 of the center portion 110, upwardly along a second side 126 of the center portion 110 and outwardly to the second point 118. The first 86 and second 90 openings leave the center portion 110 and extend upwardly toward the top edge 70 and join the remaining portion 56. The remaining portion 56 has a frangible attachment 158 to at least the center portion 110.

(7) In a further variant, the bags 50 further include an upper seam 78. The upper seam 78 seals the front wall 54 to the rear wall 58 adjacent the top edges 70. The remaining portion 56 extends between first 134 and second 138 bag handles formed by the openings 86, 90 and the upper seam 78. The remaining portion 56 has an additional frangible attachment 158 to at least one of the first 134 and second 138 bag handles. The upper seam 78 is penetrated by a cut-out 142. The cut-out 142 commences at a third point 146 along the upper seam 78 spaced inwardly from the first side edge 62 and extends to a fourth point 150 along the upper seam 78 spaced inwardly from the second side edge 66. The cut-out 142 extends downwardly toward the dispensed portion 52, thereby defining a width 154 for the first 134 and second 138 bag handles.

Figure 7:
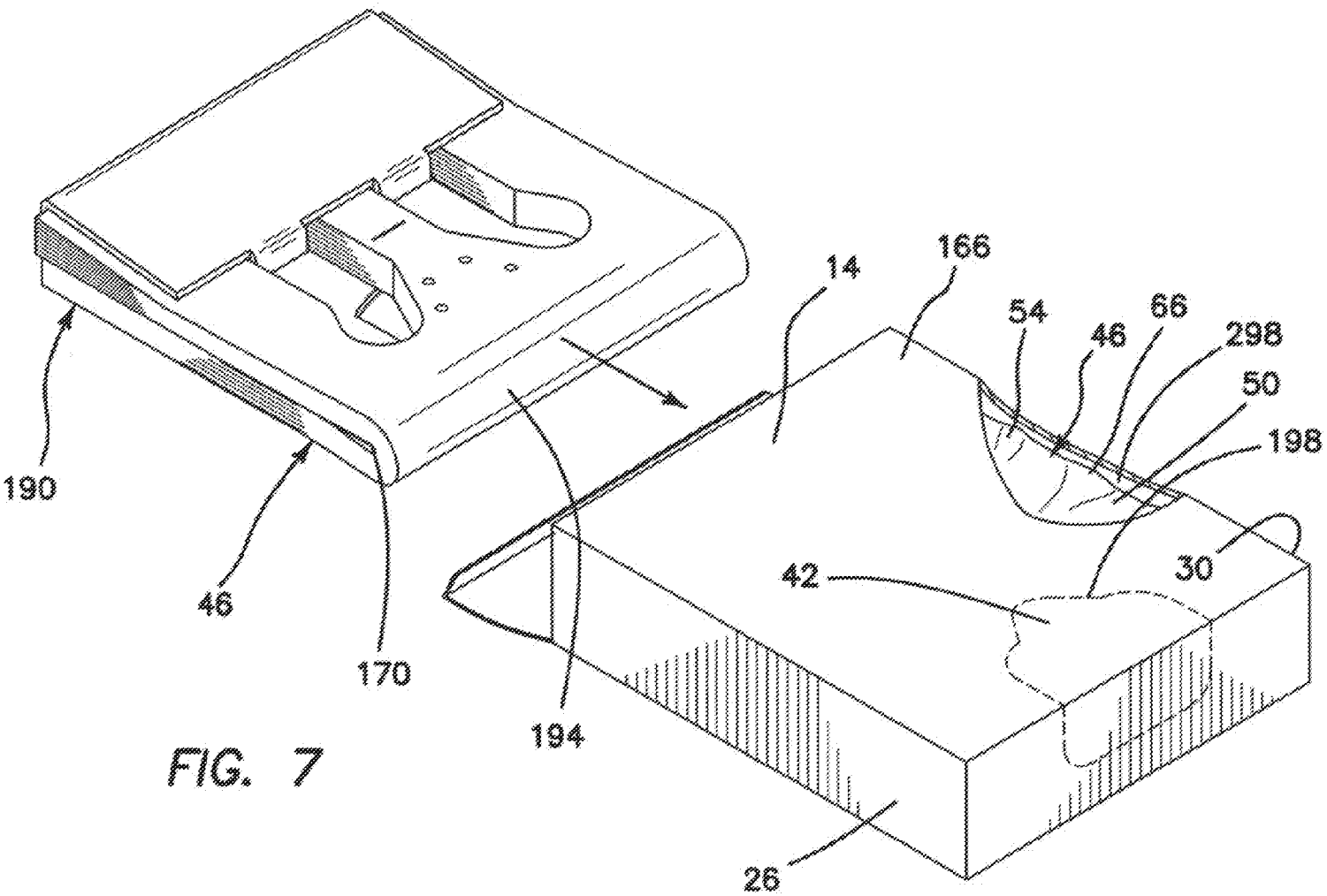
FIG. 7 is a perspective view the bag stack attached to the insert with a lower end of the bag stack folded under the insert and the dispensing container open for insertion of the bag stack into the box.
Figure 10:
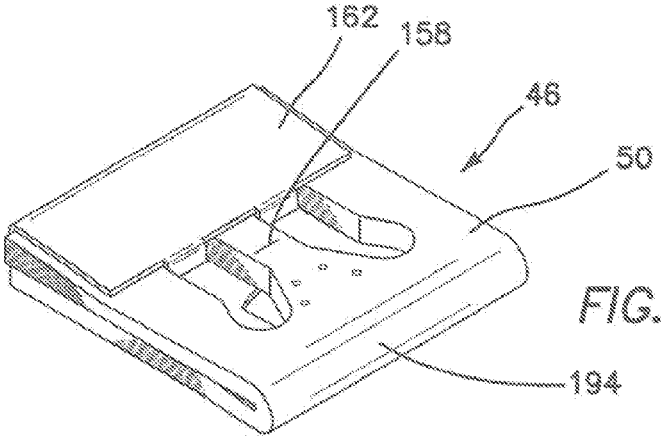
FIG. 10 is a perspective view of the FIG. 2 insert folded over a bag stack and attached with tabs and slots illustrating the bag stack folded under the insert.
Figure 11:
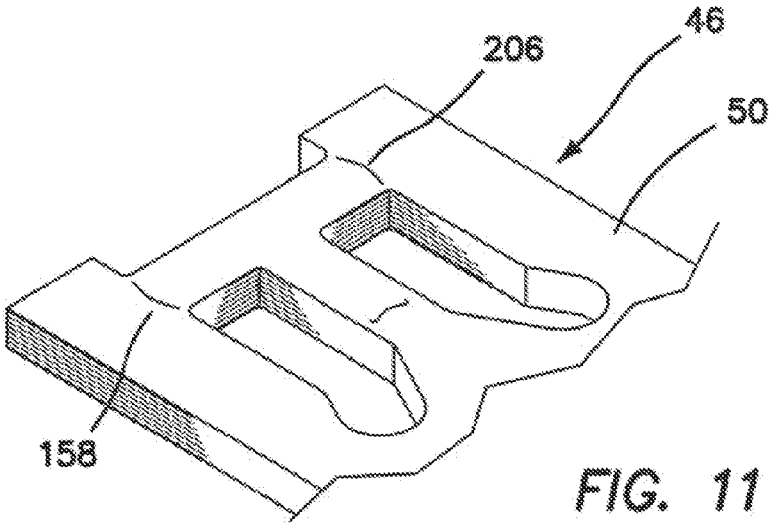
FIG. 11 is a perspective view of an upper portion of a bag stack illustrating U-shaped frangible attachments between the cross member, bag handles and center portion.
Figure 12:
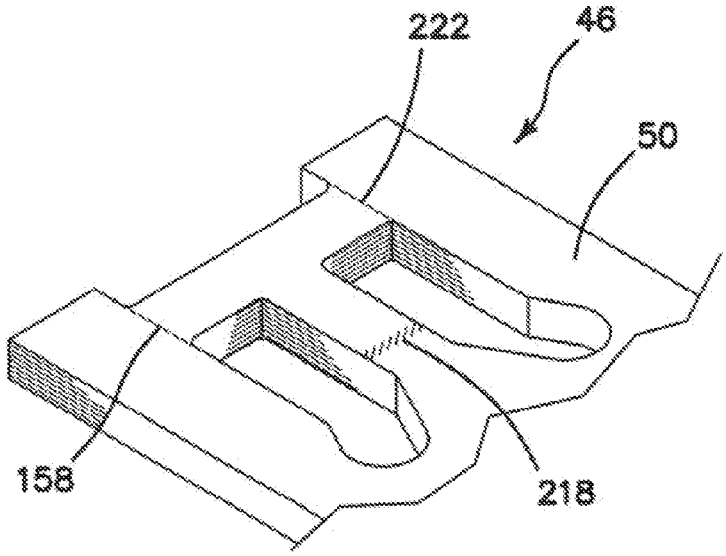
FIG. 12 is a perspective view of an upper portion of a bag stack illustrating perforations and shredding as frangible attachments between the cross member, bag handles and center portion.

(8) In still a further variant, as illustrated in FIGS. 7 and 10, a lower end 190 of the bag stack 46 is folded under the first end 170 of the insert 162 and the bag stack 46 is placed in the dispensing container 14 with a folded portion 194 of the bag stack 46 located adjacent the opening 42.

(9) In yet a further variant, as illustrated in FIG. 7, the opening 42 in the dispensing container 14 further includes surrounding perforations 198 to assist in forming the opening 42 in the container 14.

Figure 8:
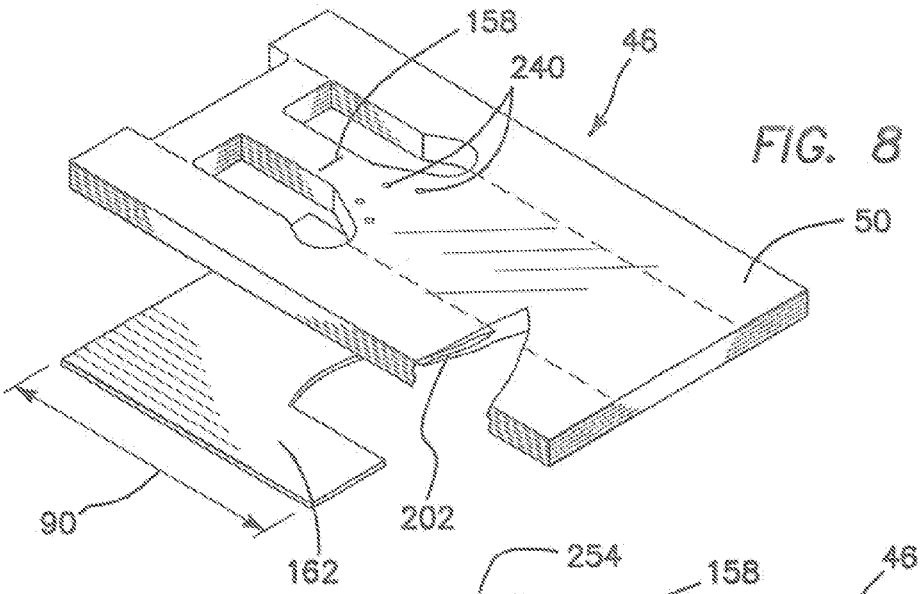
FIG. 8 is a perspective view of a bag stack of gusseted bags disposed over an alternative embodiment of the insert.

(10) In another variant of the invention, as illustrated in FIG. 8, each of the bags 50 further includes longitudinally oriented side gussets 202, the side gussets 202 forming multi-layered handles 134, 138 in the bags 50.

Figure 15:
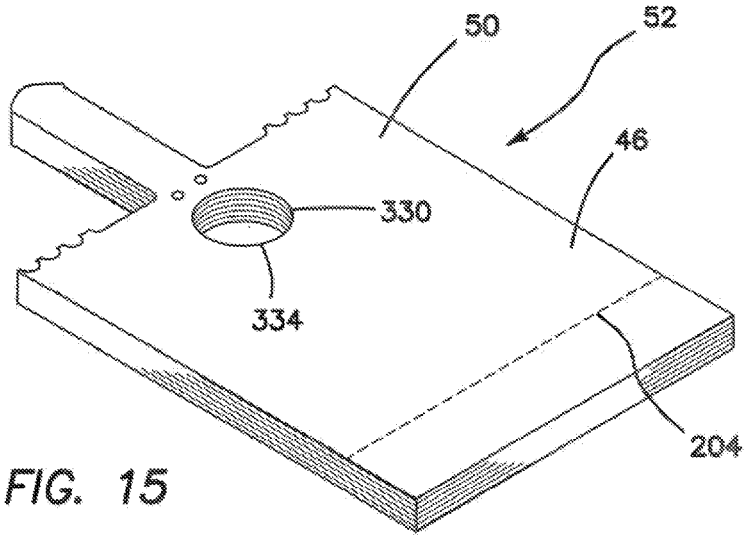
FIG. 15 is a perspective view of a stack of tabbed, bottom gusseted merchandise handle bags with a round handle opening with the remaining portion removed.
Figure 16:
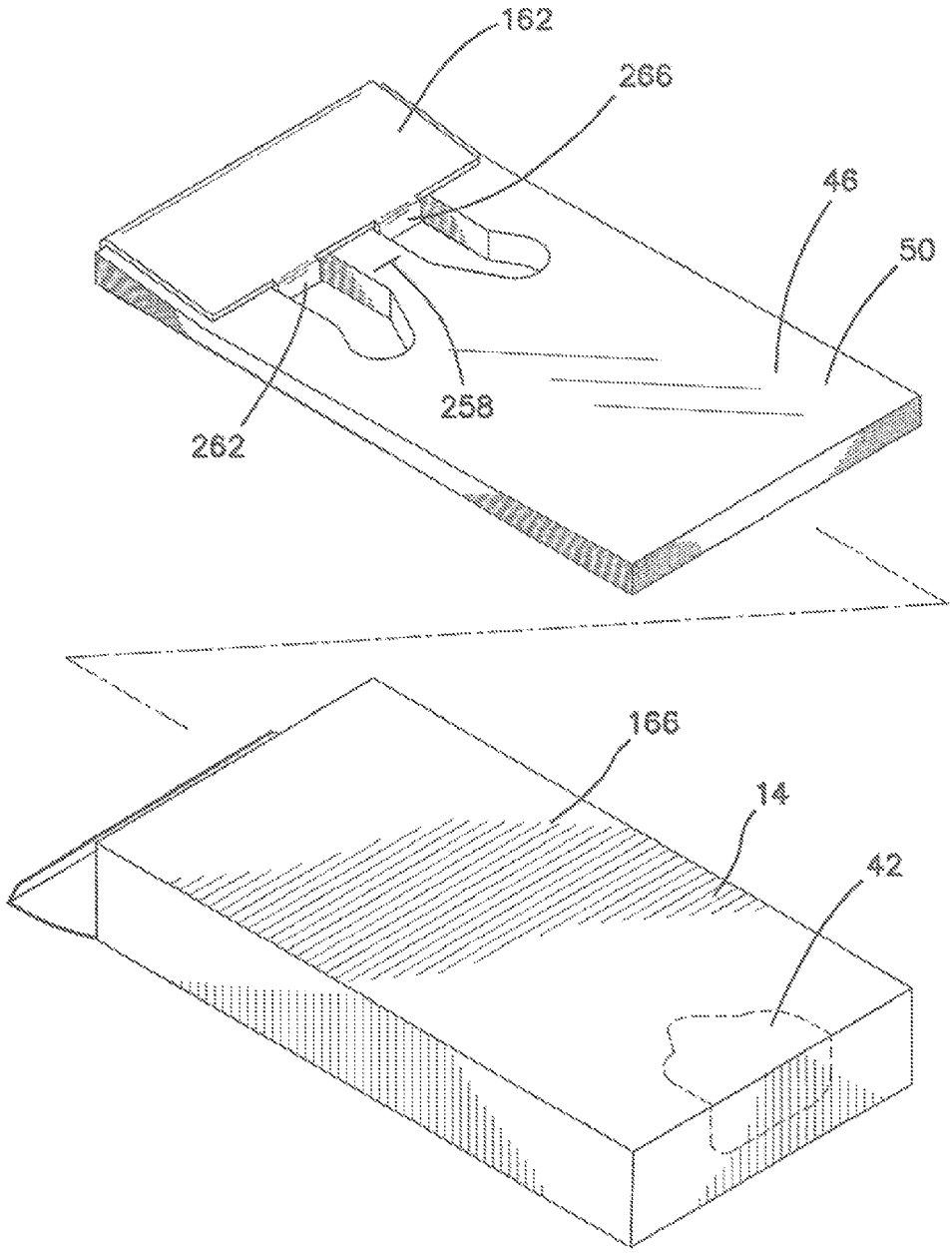
FIG. 16 is a perspective view of a stack of t-shirt type bags attached to the FIG. 2 insert prior to insertion into the container without folding the bag stack under the insert.
Figure 18:
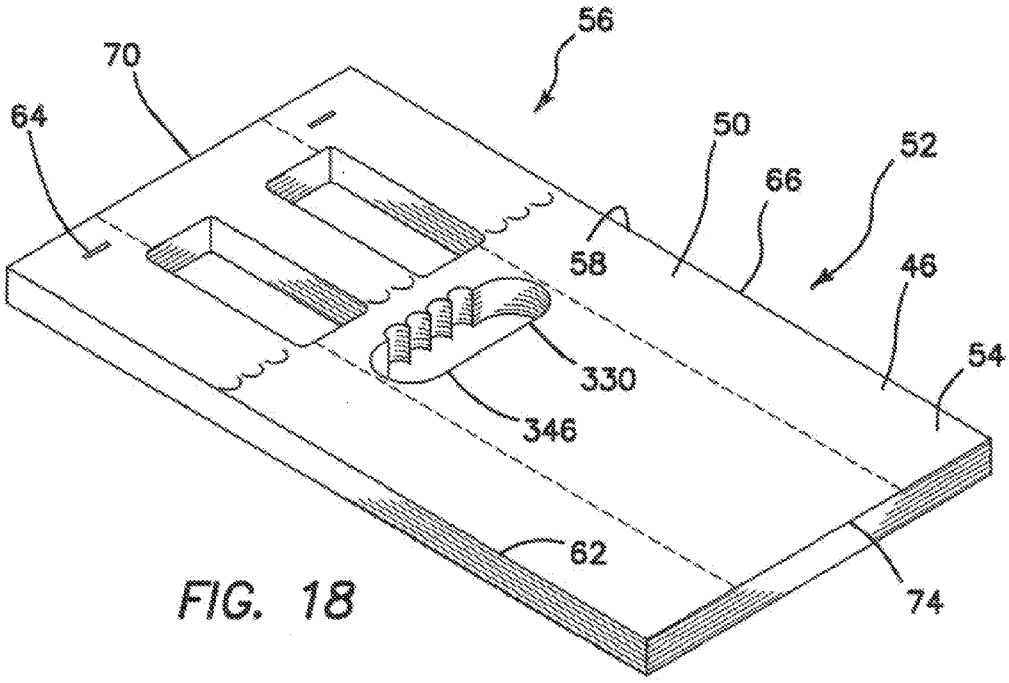
FIG. 18 is a perspective view of a stack of tabless side gusseted merchandise handle bags with a finger gripped handle opening with the dispensed portion attached to the remaining portion.
Figure 19:
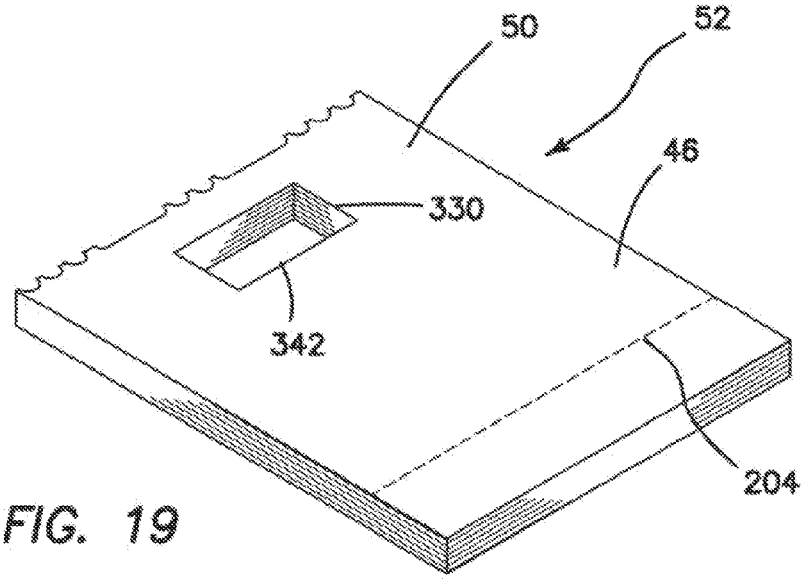
FIG. 19 is a perspective view of a stack of tabless bottom gusseted merchandise handle bags with a rectangular handle opening with the remaining portion removed.

(11) In still another variant, as illustrated in FIG. 15, each of the bags 50 further includes a bottom gusset 204.

(12) In yet another variant, as illustrated in FIGS. 4, 5, 11 and 12, the frangible attachment 158 is selected form the group includes U-shaped knife cuts 206, wave-shaped knife cuts 210, straight knife cuts 214, shredding 218 and perforations 222.

Figure 6:
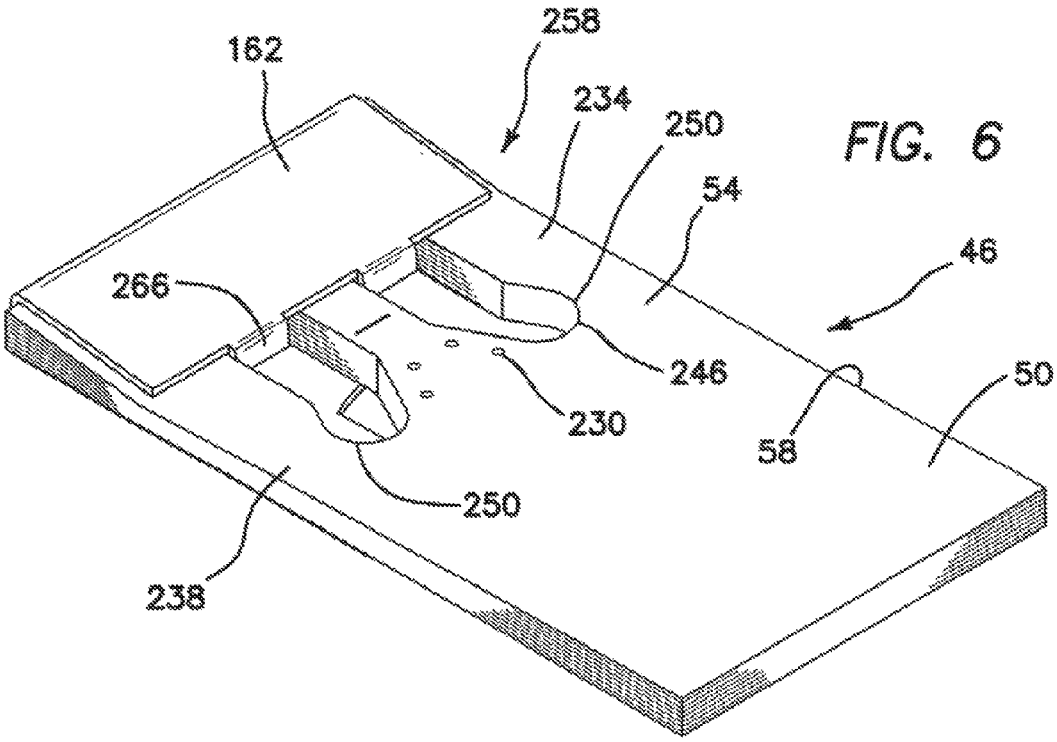
FIG. 6 is a perspective view the bag stack with the insert folded over it and the tabs inserted into the slots.
Figure 5:
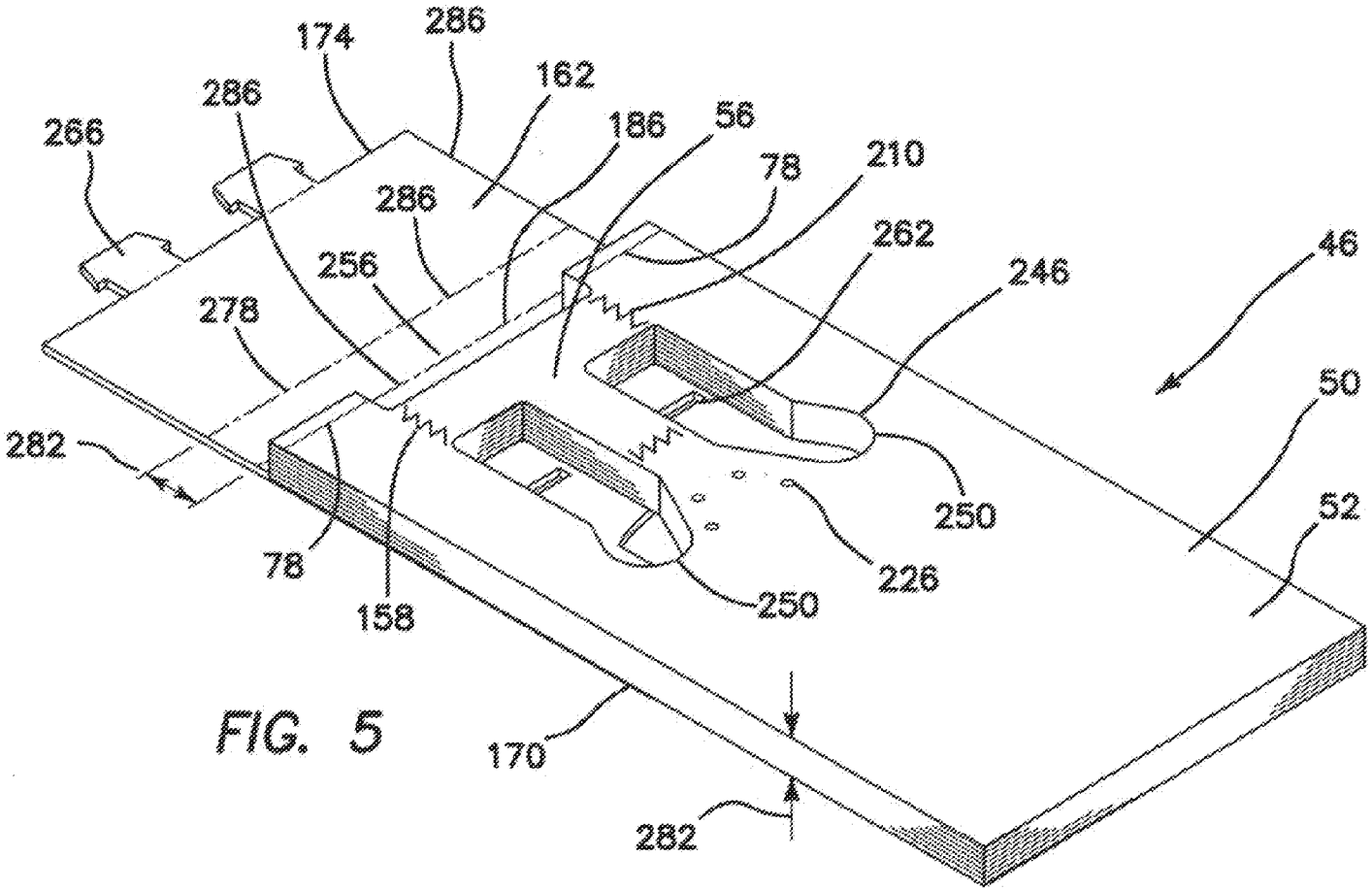
FIG. 5 is a perspective view a bag stack disposed upon the FIG. 2 insert illustrating wave shaped frangible attachments between the cross member, bag handles and the center portion.

(13) In a further variant, as illustrated in FIGS. 5, 6 and 9, each of the bags 50 in the bag stack 46 is adhered to an adjacent bag 50 in the bag stack 46 using cold staking 226, hot pinning 230, multiple corona treatment (not illustrated), knife cutting 236, special resin formulations (not shown), and glue spotting 240.

(14) In still a further variant, at least an upper portion of an outer surface 234 of the front 54 or rear 58 walls of each of the bags 50 has been corona treated 238.

(15) In yet a further variant, as illustrated in FIG. 5, lower ends 242 of the first 86 and second 90 openings include stress relieving features 246. The stress relieving features 246 includes outward and downward curving edges 250. These edges 250 extend upwardly to join the first 114 and second 126 side edges of the center portion 110.

Figure 14:
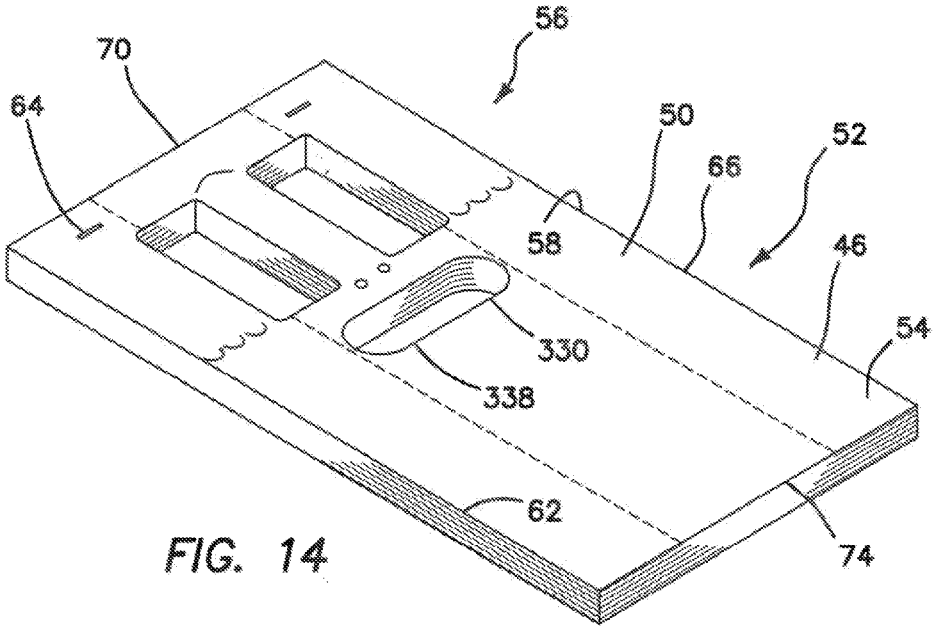
FIG. 14 is a perspective view of a stack of tabbed, side gusseted merchandise handle bags with an oval handle opening with the dispensed portion attached to the remaining portion.

(16) In another variant of the invention, as illustrated in FIGS. 8, 9 and 14, each of the bag stacks 46 is secured with any of staples 64, wires (not shown), tape (not shown), ties (not shown), glue (not shown) and cord (not shown) at the remaining portion 56 to one of the inserts 162 with the top edge 70 located adjacent the first line 186 spaced from the first end 170. The insert 162 so secured to the bag stack 46 has a second predetermined length 90.

(17) In still another variant, as illustrated in FIGS. 2, 3, 5-7 and 10, a central portion 258 of the insert 162 includes at least one slit 262. The second end 174 of the insert 162 includes at least one mating tab 266. The tab 266 secures the second end 174 of the insert 162 over the top edges 70 and the remaining portion 56.

(18) In yet another variant, the insert 162 further includes a second line 278 spaced toward the second end 174 from the first line 186. The second line 278 is spaced by approximately a thickness 282 of the at least one bag stack 46.

(19) In a further variant, the first 186 and second 278 lines are creases 286 in the insert 162, the creases 286 serving to ease folding of the insert 162 over the bag stack 46.

Figure 13:
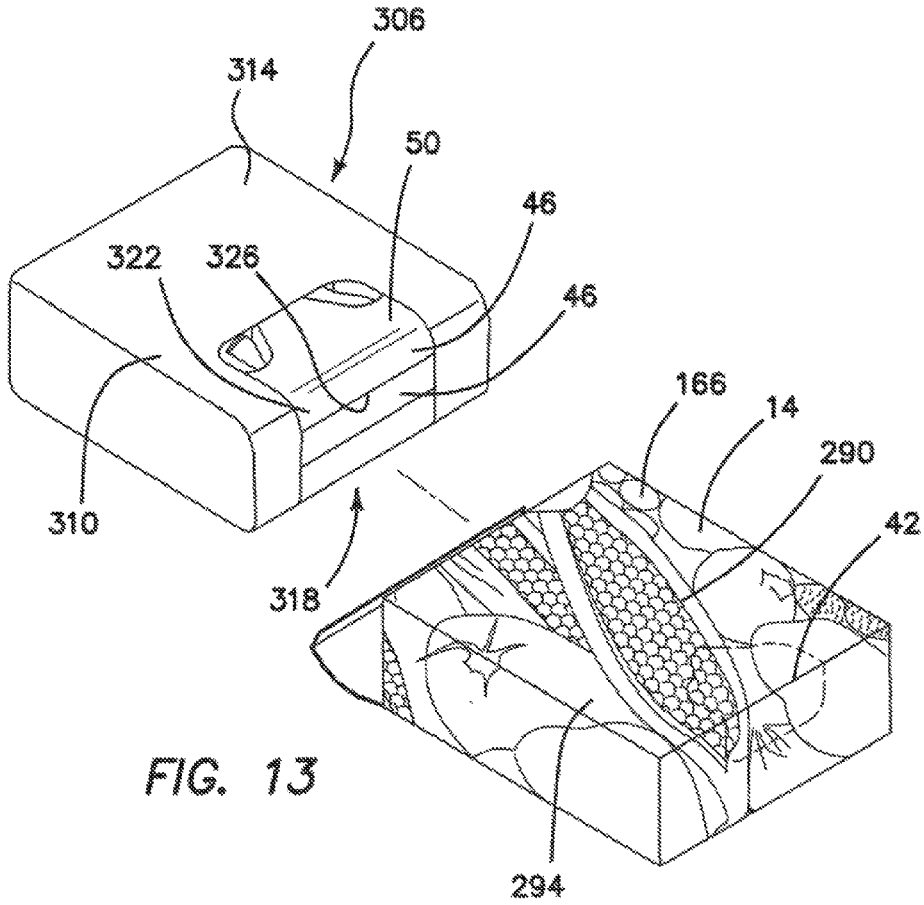
FIG. 13 is a perspective view of a bag pack enclosing several bag stacks prior to insertion into the container.
Figure 17:
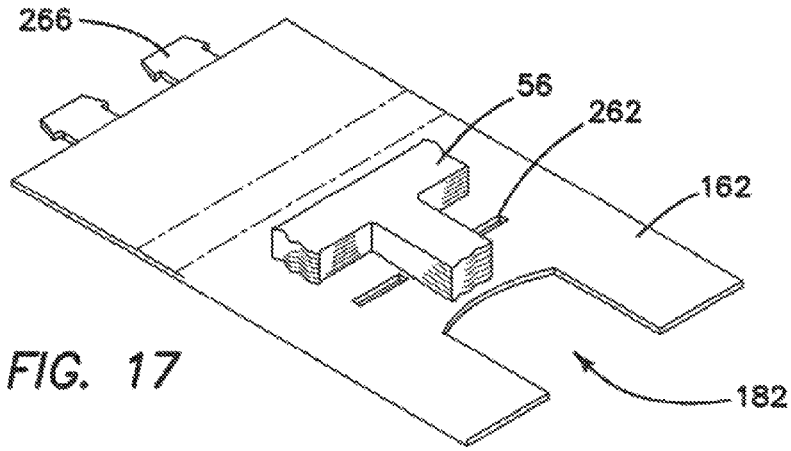
FIG. 17 is a perspective view of the FIG. 2 insert with the remaining portion of the bags of the bag stack in place after removal of the dispensed portion of the bags from the bag stack (attachment tabs not attached to mating slots)

(20) In still a further variant, as illustrated in FIG. 13, graphic images 290 are located upon at least one outer surface 294 of the dispensing container 14.

(21) In yet a further variant, as illustrated in FIG. 1, the dispensing container 14 has a top 18, a bottom 22, a first side 26, a second side 30, a front 34 and a back 38 and the opening 42 penetrates at least part of any of the top 18, the bottom 22, the first side 26, the second side 30, the front 34 and the back 38.

(22) In another variant of the invention, as illustrated in FIG. 7, at least one inner surface 298 of the first 26 and second 30 sides of the dispensing container 14 is located slidably adjacent at least one of the first 62 and second 66 side edges of the front 54 and rear 58 walls of the film bags 50, thereby providing friction as the bags 50 are withdrawn from the dispensing container 14.

(23) In still another variant, as illustrated in FIG. 1, the folded portion 194 of the bag stack 46 includes the center portion 110 of the bags 50, thereby providing a grasping point 302 for withdrawal of the bags 50 from the dispensing container 14.

(24) In yet another variant, as illustrated in FIG. 13, the bags 50 are packaged into bag packs 306. The bag packs 306 are inserted into the dispensing container 14. The bag packs 306 include at least one stack 46 of bags 50. The at least one stack 46 of bags 50 is located within an outer wrapper 310. The outer wrapper 310 is formed of flexible material 314, surrounds the at least one bag stack 46 and has an aperture

318. The aperture 318 provides access to at least one of upper 322 and lower 326 surfaces of bags 50 of the at least one bag stack 46 for removal of the bags 50 through the opening 42 in the dispensing container 14.

(25) In a further variant, as illustrated in FIGS. 14, 15, 18 and 19, the bags 50 further include handle openings 330. The handle openings 330 penetrate the front 54 and rear 58 film walls.

(26) In a final variant of the invention, the handle openings 330 have a shape selected from the group that includes round 334, oval 338, rectangular 342, triangular (not shown), hexagonal (not shown), octagonal (not shown), trapezoidal (not shown) and finger gripped 346.

The film bags in a dispensing container 10 have been described with reference to particular embodiments. Other modifications and enhancements can be made without departing from the spirit and scope of the claims that follow.

The invention claimed is:

1. Film bags in a dispensing container comprising:

a dispensing container, said dispensing container being formed of resilient material and having an opening;

at least one stack of film bags, each of said bags comprising:

front and rear film walls, each of said front and rear walls having first and second side edges, a top edge and a bottom edge;

said front and rear walls being integrally joined at said first and second side edges and being secured together at said bottom edges;

a dispensed portion and a remaining portion, said dispensed portion being removable from said dispensing container through said opening and said remaining portion being retained within said container;

said dispensed portion being removably attached to said remaining portion with at least one frangible attachment;

said at least one bag stack being sized and shaped to fit within said dispensing container;

at least one bag stack holder insert, said insert being formed of a resilient material;

said insert having a first end, a second end, a first predetermined length, open sides and having a notch at said first end, said notch having a width less than a width of said film bags, said notch being sized and shaped to at least partially align with said opening in said dispensing container and to permit access to said bags in said at least one bag stack;

each of said bag stacks being secured at said remaining portion to one of said inserts with said top edge disposed adjacent a first line spaced from said first end;

a central portion of said insert comprises at least one slit and said second end of said insert comprises at least one mating tab, said tab having retaining features at a distal end to prevent removal of said tab from said slit, said tab securing said second end of said insert over said top edges and said remaining portion; and said at least one bag stack holder insert being disposed within said dispensing container.

2. The film bags in a dispensing container, as described in claim 1, wherein each of said bags in said bag stack are adhered to an adjacent bag in said bag stack.

3. The film bags in a dispensing container, as described in claim 2, wherein each of said bags in said bag stack is adhered to an adjacent bag in said bag stack using a method selected from the group consisting of:

cold staking, hot pinning, multiple corona treatment, knife cutting, special resin formulations, and glue spotting.

4. The film bags in a dispensing container, as described in claim 1, wherein said remaining portion of said bags in said bag stack are attached to said at least one bag stack holder insert with a fastener selected from the group consisting of:

staples, wires, tape, ties cord, glue and folded resilient material.

5. The film bags in a dispensing container, as described in claim 1, wherein an upper portion of said front and rear walls are penetrated by first and second openings;

said first opening commencing at a first point spaced downwardly from said top edge and inwardly from said first side edge, extending downwardly for a first predetermined distance, inwardly to a first side of a base of a center portion, upwardly along a first side of said center portion and outwardly to said first point;

said second opening commencing at a second point spaced downwardly from said top edge and inwardly from said second side edge, extending downwardly for said first predetermined distance, inwardly to a second side of said base of said center portion, upwardly along a second side of said center portion and outwardly to said second point;

said first and second openings leaving said center portion extending upwardly toward said top edge and joining said remaining portion; and said remaining portion having a frangible attachment to at least said center portion.

6. The film bags in a dispensing container, as described in claim 1, wherein:

said bags further comprise an upper seam, said upper seam sealing said front wall to said rear wall adjacent said top edges;

said remaining portion extending between first and second bag handles formed by said openings and said upper seam;

said remaining portion having an additional frangible attachment to at least one of said first and second bag handles; and said upper seam being penetrated by a cut-out, said cut-out commencing at a third point along said upper seam spaced inwardly from said first side edge and extending to a fourth point along the upper seam spaced inwardly from said second side edge, said cut-out extending downwardly toward said dispensed portion, thereby defining a width for said first and second bag handles.

7. The film bags in a dispensing container, as described in claim 6, wherein lower ends of said first and second openings further comprise stress relieving features, said stress relieving features comprising outward and downward curving edges, said edges then extending upwardly to join said first and second side edges of said center portion.

8. The film bags in a dispensing container, as described in claim 1, wherein a lower end of said bag stack is folded under said first end of said insert and said bag stack is placed in said dispensing container with a folded portion of said bag stack disposed adjacent said opening.

9. The film bags in a dispensing container, as described in claim 8, wherein said folded portion of said bag stack comprises said center portion of said bags, thereby providing a grasping point for withdrawal of said bags from said dispensing container.

10. The film bags in a dispensing container, as described in claim 1, wherein said opening in said dispensing container further comprises surrounding perforations to assist in forming said opening in said container.

11. The film bags in a dispensing container, as described in claim 1, wherein each of said bags further comprises longitudinally oriented side gussets, said side gussets forming multi-layered handles in said bags.

12. The film bags in a dispensing container, as described in claim 1, wherein each of said bags further comprises a bottom gusset.

13. The film bags in a dispensing container, as described in claim 1, wherein said frangible attachment is selected form the group consisting of:

U-shaped knife cuts, wave-shaped knife cuts, straight knife cuts, shredding and perforations.

14. The film bags in a dispensing container, as described in claim 1, wherein at least an upper portion of an outer surface of either of said front and rear walls of each of said bags has been corona treated.

15. The film bags in a dispensing container, as described in claim 1, wherein each of said bag stacks is secured with any of staples, wires, tape, ties, glue and cord at said remaining portion to one of said inserts with said top edge disposed adjacent said first line spaced from said first end, said insert having a second predetermined length.

16. The film bags in a dispensing container, as described in claim 1, wherein said insert further comprises a second line spaced toward said second end from said first line, said second line being spaced by approximately a thickness of said at least one bag stack.

17. The film bags in a dispensing container, as described in claim 16, wherein said first and second lines are creases in said insert, said creases serving to ease folding of said insert over said bag stack.

18. The film bags in a dispensing container, as described in claim 1, wherein graphic images are disposed upon at least one outer surface of said dispensing container.

19. The film bags in a dispensing container, as described in claim 1, wherein said dispensing container has a top, a bottom, a first side, a second side a front and a back and said opening penetrates at least part of any of said top, said bottom, said first side, said second side, said front and said back.

20. The film bags in a dispensing container, as described in claim 19, wherein at least one inner surface of said first and second sides of said dispensing container is disposed slidably adjacent at least one of said first and second side edges of said front and rear walls of said film bags, thereby providing friction as said bags are withdrawn from said dispensing container.

21. The film bags in a dispensing container, as described in claim 1, wherein said bags are packaged into bag packs, said bag packs being inserted into said dispensing container, said bag packs comprising:

at least one stack of bags, said at least one stack of bags being disposed within an outer wrapper, said outer wrapper being formed of flexible material, surrounding said at least one bag stack and having an aperture; and said aperture providing access to at least one of upper and lower surfaces of bags of said at least one bag stack for removal of said bags through said opening in said dispensing container.

22. The film bags in a dispensing container, as described in claim 1, wherein said bags further comprise handle openings, said handle openings penetrating said front and rear film walls.

23. The film bags in a dispensing container, as described in claim 22, wherein said handle openings have a shape selected from the group consisting of:

round, oval, rectangular, triangular, hexagonal, octagonal, trapezoidal and finger gripped.

* * * * *